US007467964B2

(12) United States Patent
Hsu et al.

(10) Patent No.: US 7,467,964 B2
(45) Date of Patent: Dec. 23, 2008

(54) ELECTRICAL CONNECTOR

(75) Inventors: Hsiu-Yuan Hsu, Tu-Cheng (TW); Yi-Feng Wu, Tu-Cheng (TW); Tien-Chien Su, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/638,332

(22) Filed: Dec. 12, 2006

(65) Prior Publication Data

US 2007/0134964 A1 Jun. 14, 2007

(30) Foreign Application Priority Data

Dec. 12, 2005 (TW) ..... 94143787 A

(51) Int. Cl.
*H01R 13/62* (2006.01)

(52) U.S. Cl. ..... 439/331

(58) Field of Classification Search ..... 439/595, 439/607, 374, 752, 495, 260, 331
See application file for complete search history.

(56) References Cited

U.S. PATENT DOCUMENTS

| | | | | |
|---|---|---|---|---|
| 4,679,019 | A * | 7/1987 | Todaro et al. | 335/172 |
| 5,486,118 | A * | 1/1996 | Colleran et al. | 439/374 |
| 6,322,372 | B1 * | 11/2001 | Sato | 439/65 |
| 7,083,464 | B2 * | 8/2006 | Liu et al. | 439/495 |
| 2005/0287865 | A1 * | 12/2005 | Wang et al. | 439/495 |
| 2007/0133201 | A1 * | 6/2007 | Lui | 362/205 |

* cited by examiner

*Primary Examiner*—Jean F Duverne
(74) *Attorney, Agent, or Firm*—Wei Te Chung

(57) ABSTRACT

An electrical connector (1) includes a housing (10), a number of electrical contacts (20) received in the housing (10) and an actuator (30) mounted on the housing (10). In addition, the electrical connector (1) further a cover (40) disposed between the actuator (30) and the housing (10). The cover (40) is mounted above the housing (10) and the actuator (30) is pivotally disposed relative to the cover (40).

5 Claims, 6 Drawing Sheets

ELECTRICAL CONNECTOR

BACKGROUND OF THE INVENTION

1. Field of the Invention

The present invention relates to an electrical connector for electrically connecting a flexible printed circuit to a printed circuit board (PCB).

2. Description of Related Art

A conventional electrical connector for connecting a flexible printed circuit to a printed circuit board comprises an insulative housing, an actuator pivotably mounted on the housing, and a plurality of first contacts and a number of second received in the housing. The actuator presses the flexible printed circuit connecting the first contacts and the second contacts with the printed circuit board Referring to the FIG. 1-3, a conventional electrical connector 1' comprises a rectangular housing 2', a plurality of first contacts 3' and a plurality of second contacts 4' receiving in the housing 2' and an actuator 5' mounted on the housing 2' for pressing the flexible printed circuit connecting with the first and second contacts 3', 4'.

The rectangular housing 2' comprises a base 20' and a pair of engaging portion 21' extending from two ends of the base 20', a plurality of passageways 200' disposed on a front end of the housing 2' for receiving the first contacts 3' and the second contacts 4'. The base 21' defines an opening 201' for receiving the flexible printed circuit therein.

The actuator 5' is pivotally mounted on the housing 2' and comprises a rectangular pressing portion 50' and a protrusion 51' with an envelope shape extending from two ends of the pressing portion 50'. The pressing portion 50' defines a pressing surface 501' for pressing a flexible circuit board to the first contact 3' and the second contact 4'. The pressing surface 501' defines a rib 502' and a recess 503' separately, wherein the recess 503' defines a projection 504' for contacting the first contact 3'.

The first contact 3' comprises an engaging portion 30', a first securing portion 31' and a first contacting portion 32' extending from an end of the engaging portion 30' and parallel to the engaging portion 30'. The first securing portion 31' engages interferential with the housing 2' and the first contacting portion 32' contacts with a flexible circuit board. The engaging portion 30' further defines a concave 300' for receiving the projection 504' of the actuator 5'; hence the actuator 504' can be rotated about the first contacts 3' from an opening position to a horizontal position. In the opening position, the actuator 5' do not press the first contacts 3' and the second contacts 4', however, in the horizontal position, the actuator 5' presses the first contacts 3' and the second contacts 4' tightly. The second contact 4' is h-shaped and is inserted into the passageways 211' of the housing 2' from an end opposite to the opening 201'. The second contact 4' comprises a second securing portion 40' and a second contacting portion 41' extending from and parallel to the second securing portion 40'. The second securing portion 40' engages interferentially in the housing 2' and the second contacting portion 41' contacts the flexible circuit board. The first contacts 3' and the second contacts 4' are welded on a chip module by the surface material technology, which are soldered to the chip module by the two electrical connectors 1'. The two electrical connectors 1' are connected by a flexible circuit board.

However, the electrical connector 1' described in the above lies in following drawbacks: the actuator 5' in the electrical connector 1' is connected with the first contacts 3' by recess 300' of the engaging portion 30' with projection 504' of the actuator 5'. So the actuator 5' must define a plurality of concave 503' corresponding to the number of the first contacts 3', which leads to a complex structure thereof. In addition, a plurality of concaves 503' must lead to a decreasing intensity of the whole actuator 5'. For engaging with actuator 5', each first contact 3' must define the engaging portion 30' thereof for engaging with actuator 5', thereby each first contact 3' has a different shape with each second contact 4'. Due to the difference between the first contacts 3' and the second contacts 4', the high frequency of the first contact and the second contact is different from each other. By the aforementioned analysis, the electrical connector 1' has a lot of place need to be improved.

Thereby, an improved electrical connector is required to overcome the disadvantages of the prior art.

SUMMARY OF THE INVENTION

An object of the present invention is to provide an electrical connector which has reliable structure and can perform steadily electrical connection between a flexible printed circuit and a printed circuit board (PCB).

In order to achieve above-mentioned objects, an electrical connector in accordance with a preferred embodiment of the present invention includes a housing, a number of electrical contacts received in the housing and an actuator mounted on the housing. In addition, the electrical connector further a cover disposed between the actuator and the housing. The cover is mounted above the housing and the actuator is pivotally disposed relative to the cover.

As an improvement of the invention, the electrical connector define a pair of contacts with same structure.

Relative to the conventional technology, the cover corresponding to the invention can simplify the connecting structure of the housing and the actuator, decrease the designing cost of the mold of the housing, improve the whole connecting intensity of the electrical connector, which ensure the electrical connector a stable and reliable electrical and mechanical connection. In addition, the contacts are simplified configured as same structure according to the invention, which can abbreviate the producing technology, decreasing the producing cost, improving the electrical transmission.

Other objects, advantages and novel features of the present invention will become more apparent from the following detailed description of the present embodiment when taken in conjunction with the accompanying drawings.

DETAILED DESCRIPTION OF THE INVENTION

Figure 1:
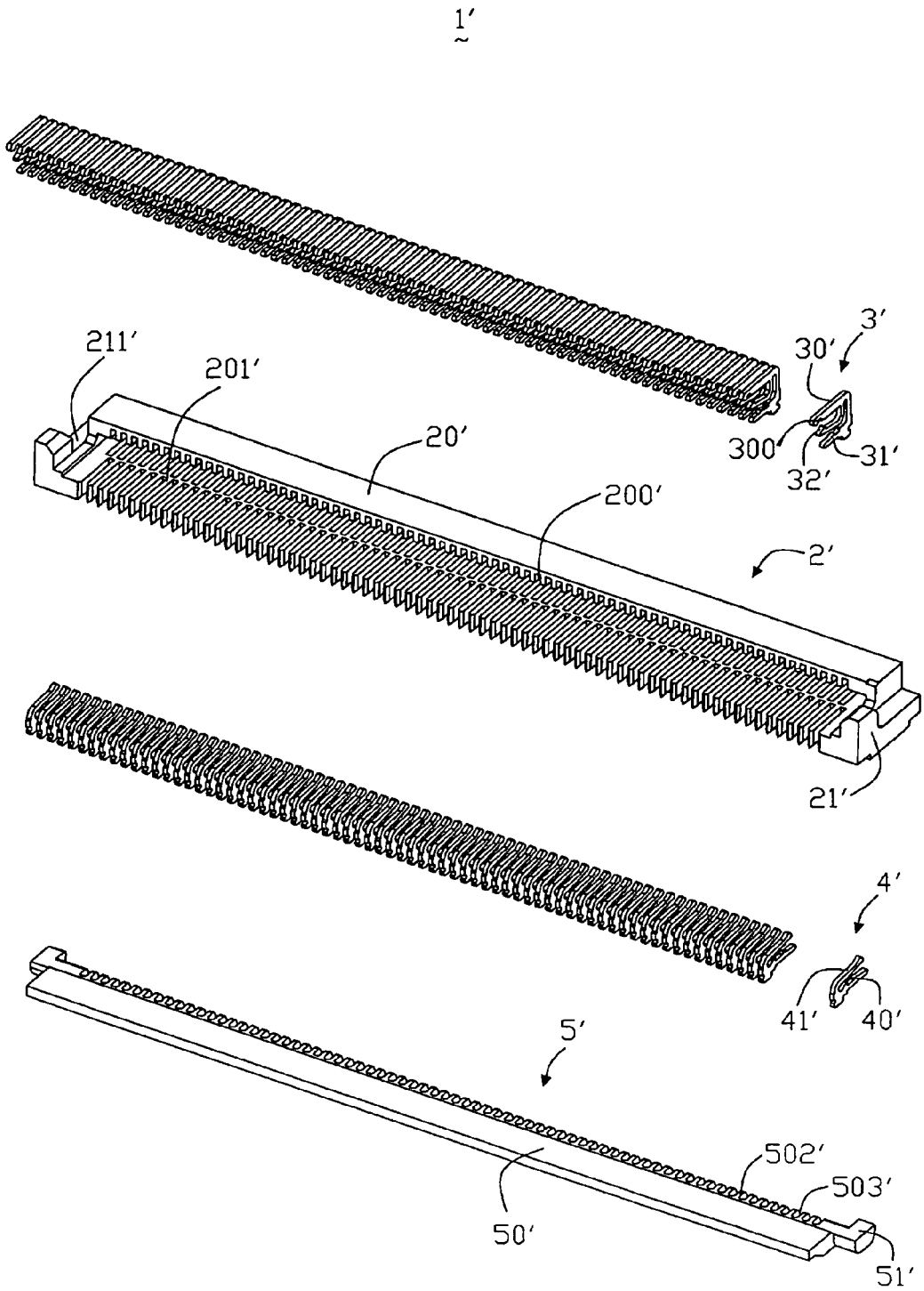
FIG. 1 PRIOR ART
FIG. 1 is an exploded, isometric view of a conventional electrical connector.
Figure 2:
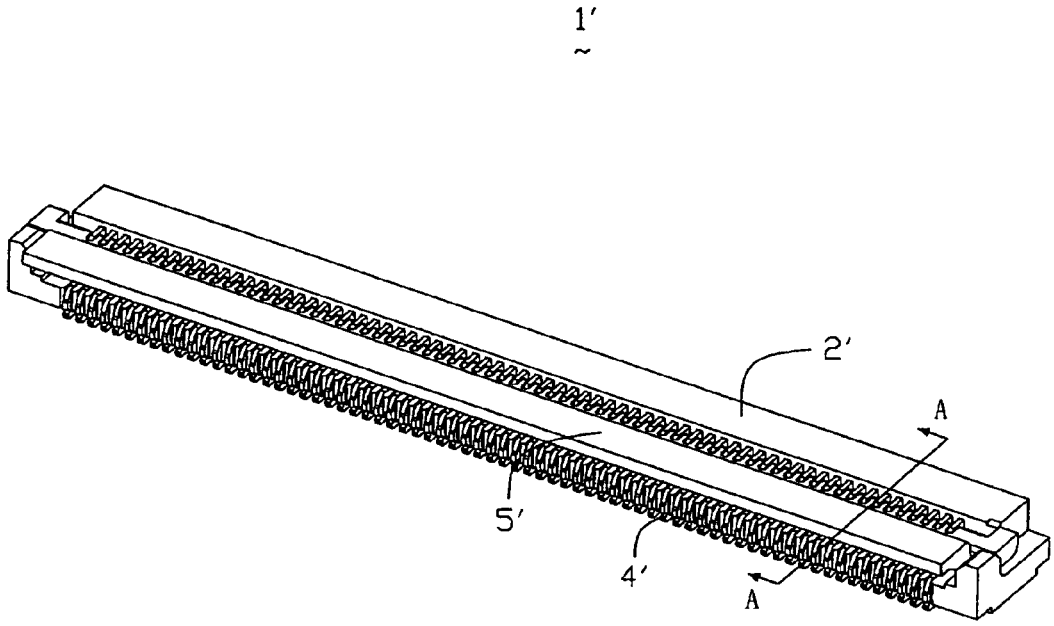
FIG. 2 PRIOR ART
FIG. 2 is an assembled view of the electrical connector described in FIG. 1.
Figure 3:
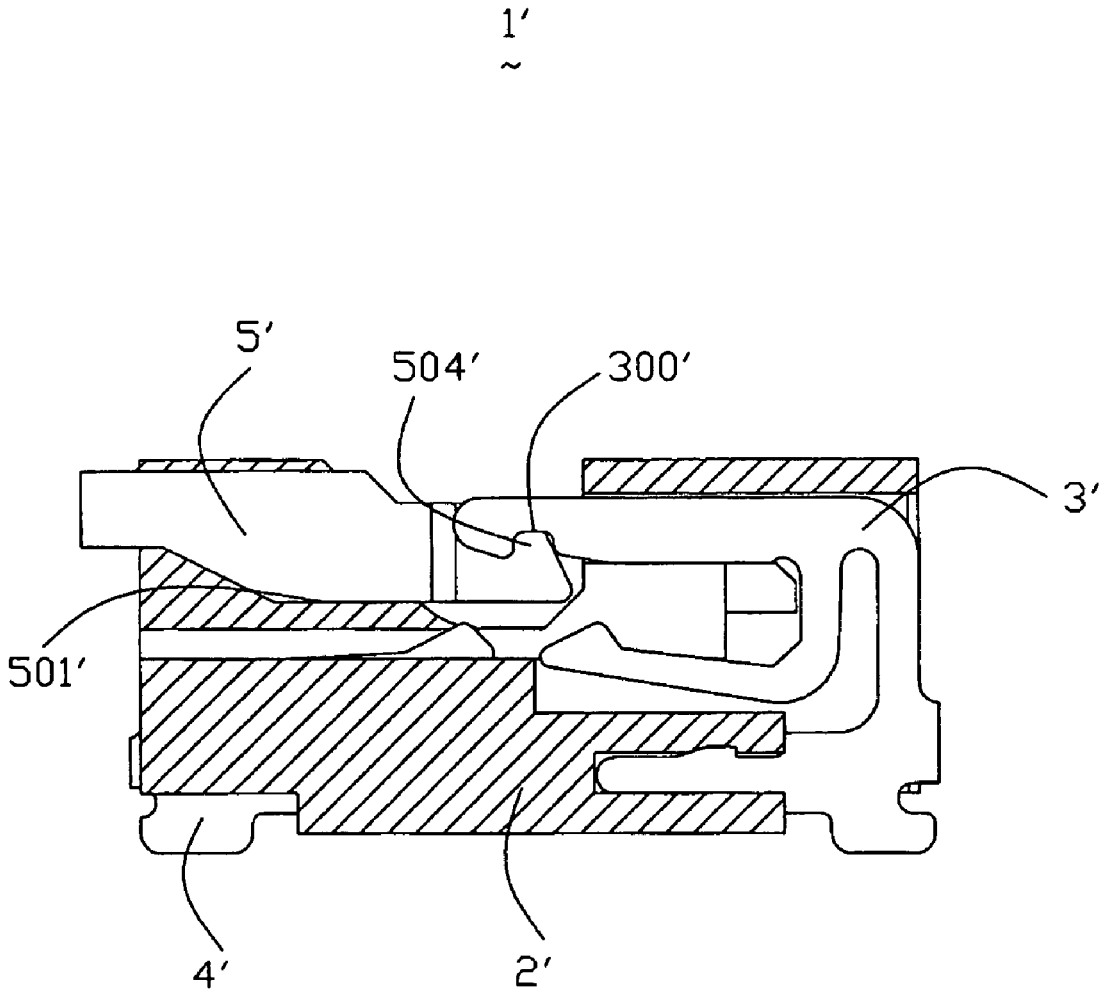
FIG. 3 PRIOR ART
FIG. 3 is a cross-sectional view of the electrical connector shown in FIG. 1 in line of the III-III.

Reference will now be made to the drawing figures to describe the present invention in detail.

Figure 4:
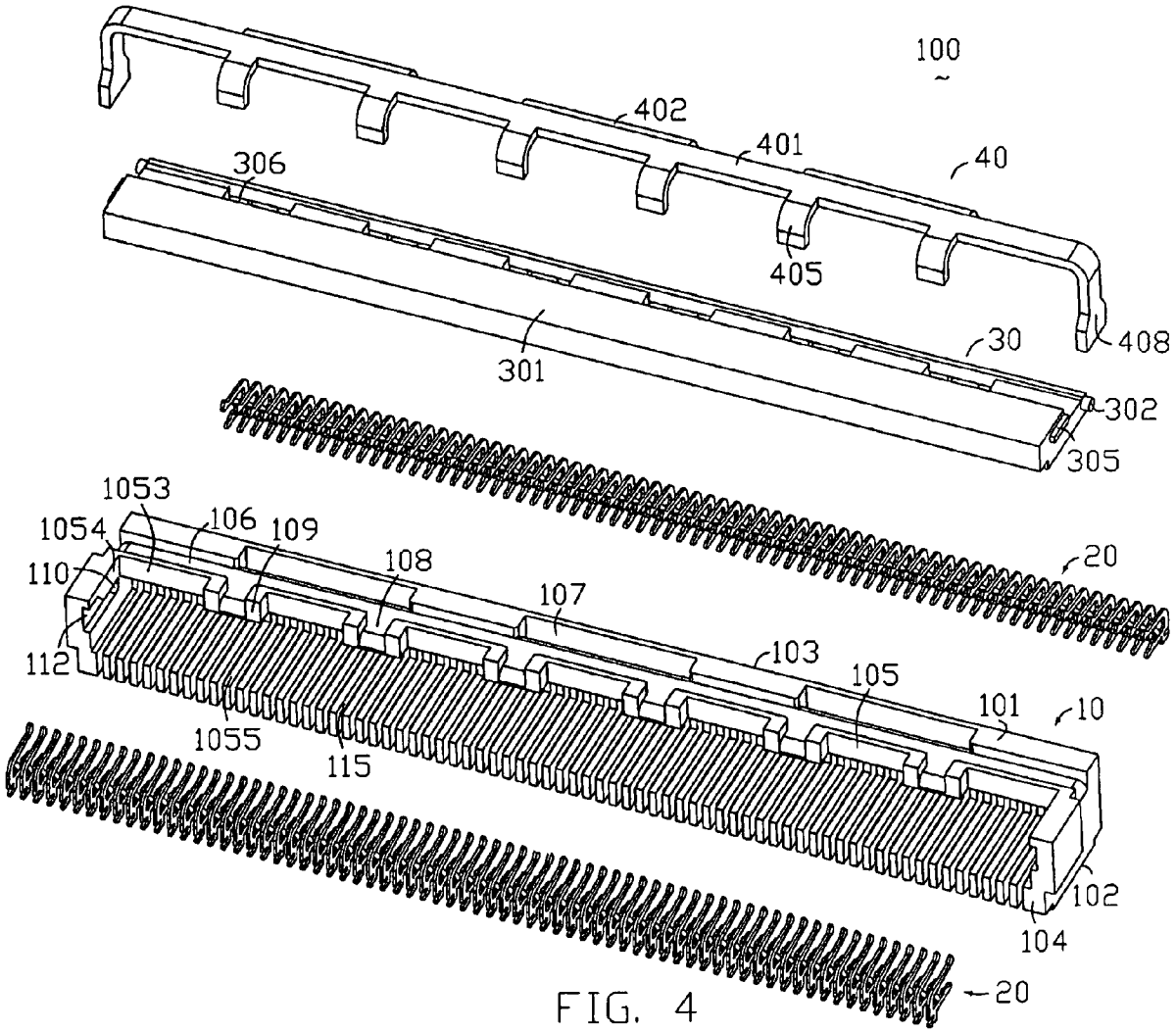
FIG. 4 is a an exploded, isometric view of an electrical connector in accordance with the preferred embodiment of the invention.
Figure 5:
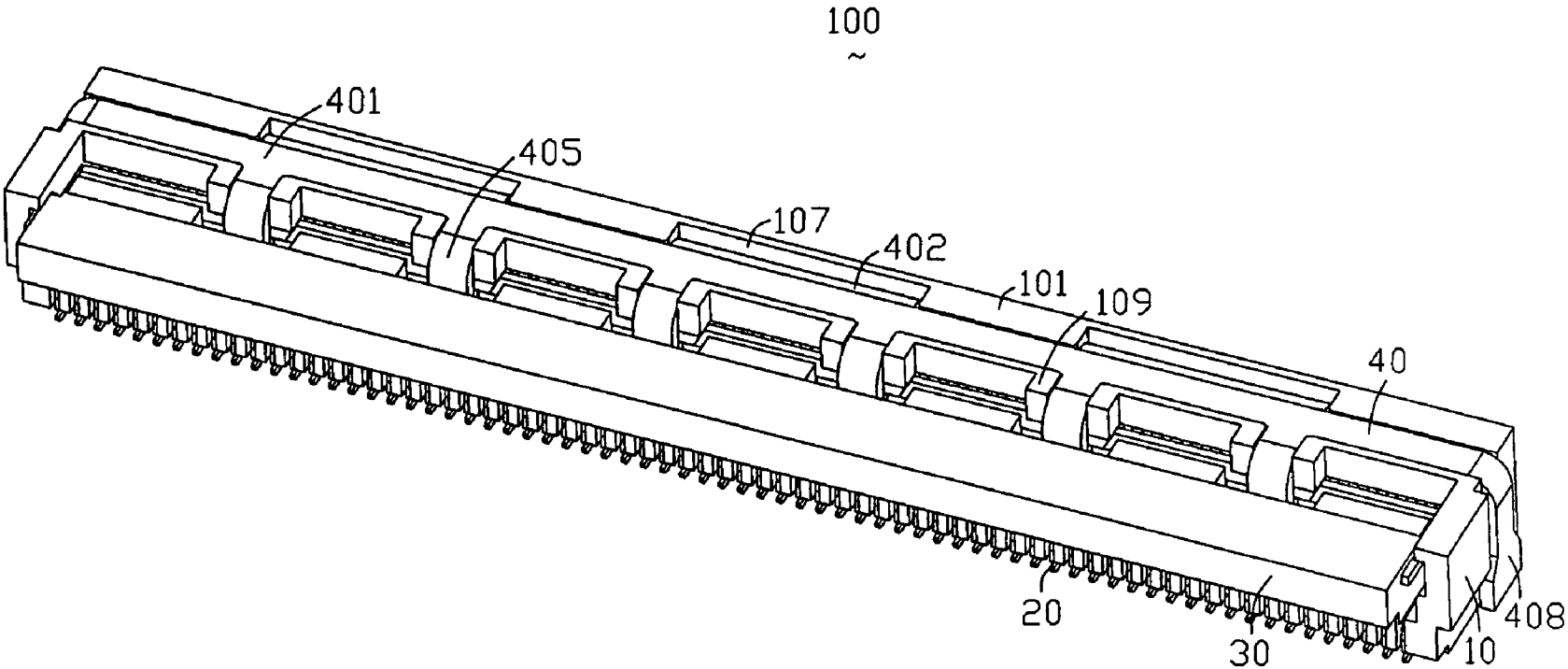
FIG. 5 is an assembled view of the electrical connector shown in FIG. 4.

Referring to FIGS. 4-5, an electrical connector 1 in accordance with the preferred embodiment of the present invention comprises a housing 10, a plurality of electrical contacts 20 received in the housing 10, an actuator 30 mounted pivotally on the housing 10, and a cover 40 disposed above the housing 10.

The rectangular housing 10 comprises a first surface 101 and a second surface 102 parallel to the first surface 101, a first sidewall 103 and a second sidewall 104 perpendicular to the first surface 101. The first surface 101 defines downwardly a plurality of receiving slots 105 and a securing channel 106, which do not penetrate through the second surface 102. The housing 10 further defines a first receiving recess 107 adjacent to the first sidewall 103 in a transverse direction, a second receiving recess 108 adjacent to the second sidewall 104. The receiving slots defines a bottom surface 1055, a first inner surface 1053 and a second inner surface 1054 perpendicular to the first inner surface 1053, an anchoring projection 109 extending from the first inner surface 1053 toward the second sidewall 104, and a first engaging slot 110 and a second engaging slot 112 disposed on the second inner surface 1054 and connecting with each other. In addition, the second surface 102 defines inwardly a pair of receiving passageways 115 for receiving the contacts 20 therein.

The actuator 30 defines a rectangular base plate 301. The base plate 301 comprises the retention post 302, a securing projection 305 extending from two lengthwise ends thereof and a plurality of concaves 306 for engaging with the second hooks 405 of the cover 4.

The cover 40 comprises a rectangular base portion 401, a first engaging hook 402 and a second engaging hook 405 disposed on two transverse ends thereof. The base portion 401 defines a pair of cured solder tails 408 on the on longitudinal ends thereof for connecting to the printed circuit board, which can enhance the stability and reliability of the connection between the electrical connector 1 and the printed circuit board.

Figure 6:
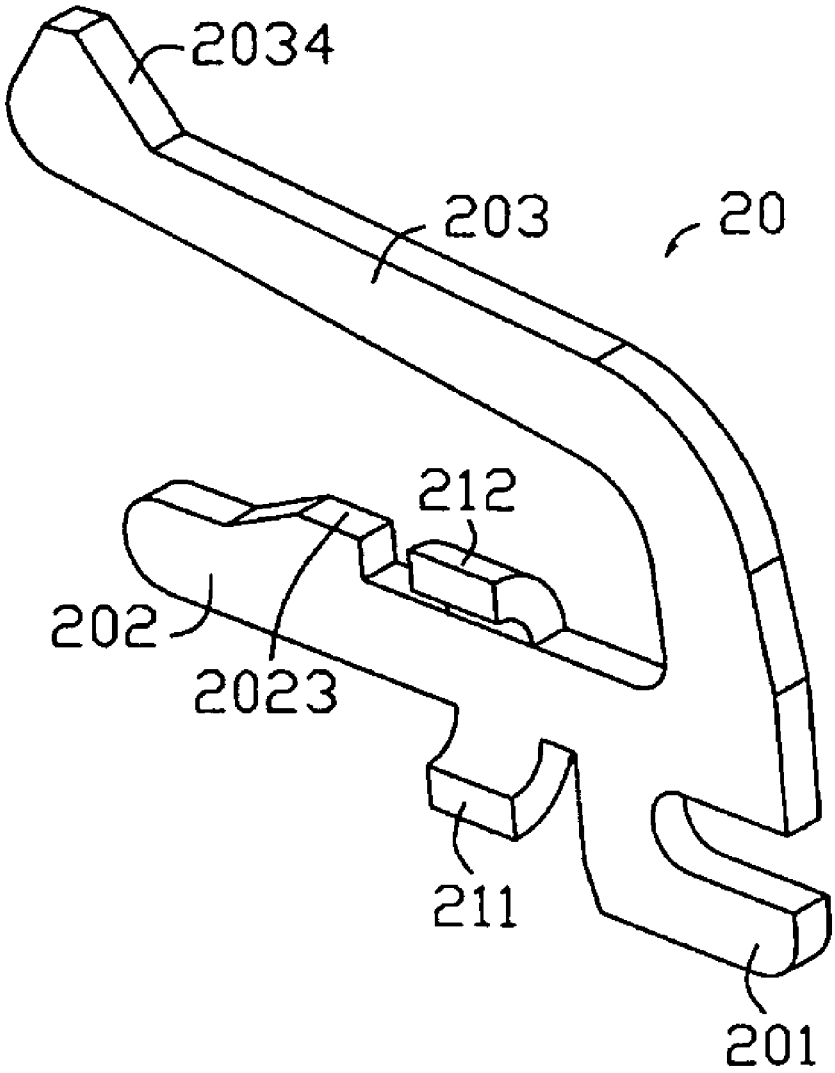
FIG. 6 is an exploded, isometric view a contact shown in FIG. 4.

Referring to FIGS. 4-6, each contact 20 defines a solder portion 201, a retention portion 202 and an elastic portion 203 with a contacting portion 2034. The retention portion 202 extends a first projection 211 and a second projection 212 for decreasing the thickness of the contacts 20, which is disposed on upper and lower position of the retention portion 202 respectively. The retention portion 202 defines an engaging portion 2023 for engaging with the corresponding portion of the receiving passageway 115. When the contacts 20 are inserted into the receiving passageway 115 of the housing 10, the distances between the contacts 20 and the inner wall of the receiving passageways 115 are decreased, hence improving the stability of the pressed contacts 20. The retention portion 202 defines an anchoring portion 2023 for engaging with the receiving passageways 115. When assembled, the contacts 20 are arranged in two arrays and opposite to each other.

In assembly, the contacts 20 are inserted into the receiving passageways 115 of the housing 10 and arranged opposite to each other, wherein the elastic portion 203 partially extends out of the receiving slot 105 of the housing 10, namely a free end of the elastic portion 203 locating above the bottom surface 1055 of the receiving slot 105, and the solder portion 201 extends beyond the receiving holes in order to solder to the printed circuit board. And then the actuator 30 is inserted into the housing 10 in a direction parallel the first surface 101 of the housing 10, in the state, the a lower surface of the anchoring projection 109 abuts against a corresponding surface of the actuator 30, the retention post 302 of the actuator 30 are engaged with the first engaging slot 110 of the housing 10, the securing projection 305 are received in the second engaging slot 112. At this time, the actuator 30 mounted on the housing 10 can rotate about the retention post of the actuator 30. At last, the cover 40 is mounted on the housing 10, the base portion 401 engages with the securing channel 106 of the housing 10 and the first hook 402 is inserted into the first receiving recess 107, the second hook 405 is inserted into the second receiving recess 108. Hence the cover 40 is located on the housing 10.

In conclusion, the electrical connector 1 in accordance with the invention can simplify the connecting structure of the housing 10 and the actuator 30, decrease the designing cost of the mold of the housing 10, improve the whole connecting intensity of the electrical connector 1, which ensure the electrical connector 1 a stable and reliable electrical and mechanical connection via the cover 40 disposed on the housing. In addition, the contacts 20 are simplified configured as same structure according to the invention, which can abbreviate the producing technology, decreasing the producing cost, improving the electrical transmission.

The invention claimed is:

1. An electrical connector for electrically connecting a flexible printed circuit to a printed circuit board, comprising:

a housing defining a plurality of passageways therethrough and an open space in communication with the passageways;

a plurality of contacts received in the passageways and extending into the open space; and an actuator having a pair of retention posts on two opposed longitudinal ends thereof, the actuator pivotally assembling to the housing by the retention posts engaging with the housing and rotating about the retention post.

2. The electrical connector as described in claim 1, wherein the housing defines a securing recess for receiving the cover.

3. The electrical connector as described in claim 2, wherein the contacts are arranged in two arrays and opposite to each other.

4. The electrical connector as described in claim 1, wherein the contacts have a same structure.

5. The electrical connector as described in claim 4, wherein each contact comprises a solder portion, a retention portion and an elastic portion, and the retention portion defines at least a projection along a thickness direction of the contact.

* * * * *